United States Patent [19]

Watermann

[11] 4,056,941

[45] Nov. 8, 1977

[54] MINE ROOF SUPPORT FOR AN UNDERGROUND MINE GALLERY

[75] Inventor: Willy Watermann, Dortmund-Lanstrop, Germany

[73] Assignee: Klockner-Werke AG, Duisburg, Germany

[21] Appl. No.: 758,303

[22] Filed: Jan. 10, 1977

[30] Foreign Application Priority Data

Jan. 15, 1976 Germany ..... 2601341

[51] Int. Cl.[2] ..... E21D 15/44

[52] U.S. Cl. ..... 61/45 D

[58] Field of Search ..... 61/45 D; 299/31–33; 248/357; 91/170 MP

[56] References Cited

U.S. PATENT DOCUMENTS

| | | | |
|---|---|---|---|
| 3,347,050 | 10/1967 | Dommann et al. | 61/45 D |
| 3,874,178 | 4/1975 | Kunzer | 61/45 D |

FOREIGN PATENT DOCUMENTS

| | | | |
|---|---|---|---|
| 1,267,641 | 5/1968 | Germany | 61/45 D |
| 2,246,745 | 8/1973 | Germany | 61/45 D |

*Primary Examiner*—Dennis L. Taylor

*Attorney, Agent, or Firm*—Michael J. Striker

[57] ABSTRACT

A mine roof support for an underground mine gallery comprises a sole plate adapted to rest on the floor of the mine gallery, a front shield having a front end directed toward the mine face, a rear shield pivotedly connected at one end to the other end of the front shield and projecting rearwardly therefrom, a rocker arm connected at opposite ends respectively to the front and to the rear shield intermediate opposite ends of the shields, an expandable and contractable prop connected at one end to said rocker arm intermediate the ends of the latter and at the other end to said sole plate, and a pair of arms each pivotally connected at one end to the region of the rear shield distant from the front shield and at the other end to the sole plate.

10 Claims, 3 Drawing Figures

MINE ROOF SUPPORT FOR AN UNDERGROUND MINE GALLERY

BACKGROUND OF THE INVENTION

The present invention relates to a mine roof support for an underground mine gallery, comprising a sole plate adapted to rest on the floor of a mine gallery and having a front end directed toward the mine face, a rear shield pivotally connected to the other end of the sole plate, while a front shield adapted to engage the roof of a mine gallery is linked to the end of the rear shield which faces the mine face.

In a known mine roof support of the aforementioned kind, the front shield is supported by a prop on the sole plate and fluid operated cylinder and piston means are connected at opposite ends to the front shield and the rear shield, respectively. In such a construction, the free space beneath the front shield which is protected by the latter is relatively small. Due to this disadvantage, such a mine roof support can be used only in mine galleries in which the coal is mined by planing.

In order to increase the free available space beneath the front shield, it is also known to support the rear shield with a prop and to arrange cylinder and piston means between the rear shield and the front shield. In this way a greater free space beneath the front shield will be obtained, so that such mine roof supports may also be used in underground mine galleries in which the coal is mined by rotating cutters. However, in such mine roof supports the danger exists that the front shield will tilt downwardly in an uncontrolled manner if the cylinder and piston means between the front shield and the rear shield should become defective.

SUMMARY OF THE INVENTION

It is an object of the present invention to provide a mine roof support for an underground mine gallery which avoids the disadvantages of such mine roof supports known in the art.

It is a further object of the present invention to provide a mine roof support in which a greater protected free space is provided beneath the front shield of the mine roof support than in mine roof supports known in the art so that such mine roof supports may be used in underground mine galleries in which planers or rotating cutters may be used for mining the coal.

It is an additional object of the present invention to provide a mine roof support of the aforementioned kind which is constructed of relatively few and simple parts so that the mine roof support can be manufactured at reasonable cost and will stand up properly under extended use.

With these and other objects in view, which will become apparent as the description proceeds, the mine roof support according to the present invention for use in an underground mine gallery mainly comprises a sole plate adapted to rest on the floor of the mine gallery and having a front end directed toward the mine face, a rear shield having a front end pivotally connected to the other end of the front shield and projecting rearwardly from the latter, a rocker arm connected at opposite ends respectively to the front and to the rear shield, intermediate the opposite ends of these shields, expandable and contractable prop means supporting the rocker arm on the sole plate, and means pivotally connecting the other end of the rear shield to the sole plate.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
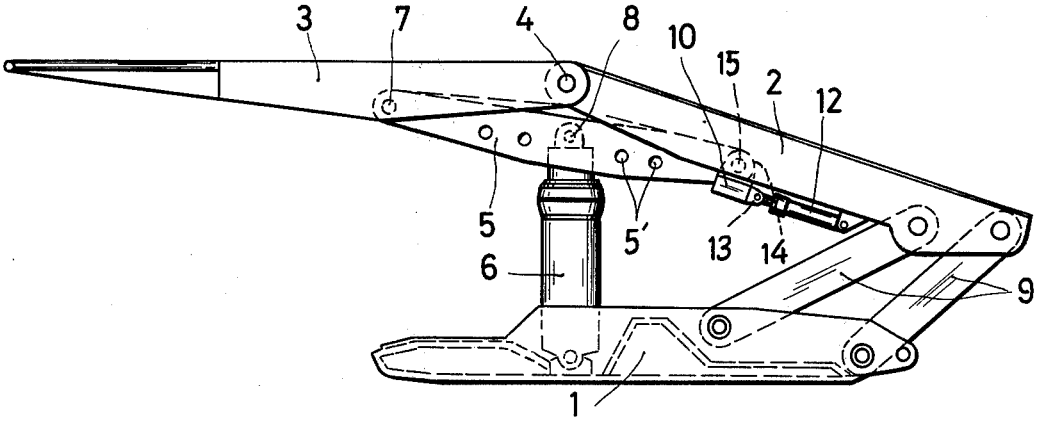
FIG. 1 is a side view of a first embodiment of a mine roof support according to the present invention.

Referring now to the drawing, it will be seen that each of the embodiments of the mine roof support according to the present invention comprises a sole plate 1 adapted to rest on the floor of a mine gallery, not illustrated in the drawing, and having a front end, shown in the drawing at the left end, directed toward the likewise not illustrated mine face of the mine gallery, a rear shield 2 connected in the region of its rear end, shown in the drawing at the right end, by arm means in form of a pair of arms 9 respectively pivoted at opposite ends thereof to the rear shield 2 and sole plate 1, whereas the front end or left end of the rear shield 2 is connected by a pivot pin 4 to a front shield 3 which is adapted to bear against the likewise not illustrated roof of an underground mine gallery. A rocker arm 5 is arranged between the rear shield 2 and the front shield 3 and this rocker arm 5 is supported by means of an expandable and contractable prop 6 on the sole plate 1.

In all three embodiments shown, the left end of the rocker arm 5, as viewed in the drawing, is pivotally connected at 7 to the front shield 3 whereas the other end of the rocker arm 5 is floatingly mounted on the rear shield 2. Of course, it is also possible to reverse the arrangement, that is, to pivotally connect one end of the rocker arm 5 to the rear shield 2 and to floatingly connect the other end of the rocker arm to the front shield 3.

The upper end of the prop 6 is adjustably connectable to the rocker arm 5. For this purpose, the rocker arm 5 is provided with a plurality of bores 5', spaced in the direction of the elongation of the rocker arm from each other, and the upper end of the prop 6 is pivotally connected to the rocker arm 5 by a pin 8 extending through a transverse bore in the upper end of the prop 6 and a selected one of the bores 5' in the rocker arm.

The floating connection between the right end of the rocker arm 5, as viewed in FIG. 1, and the rear shield 2 may comprise, as shown in FIG. 1, a bracket 10 connected to the rear shield 2 and guiding a sliding bar 13 movably in longitudinal direction of the rear shield 2, which sliding bar is connected by an upwardly extending ear 14 and a pivot pin 15 to the right end of the rocker arm 5. Fluid operated cylinder and piston means 12 are interconnected between one end of the sliding bar 13 and the rear shield 12, in the manner as shown in FIG. 1.

Figure 2:
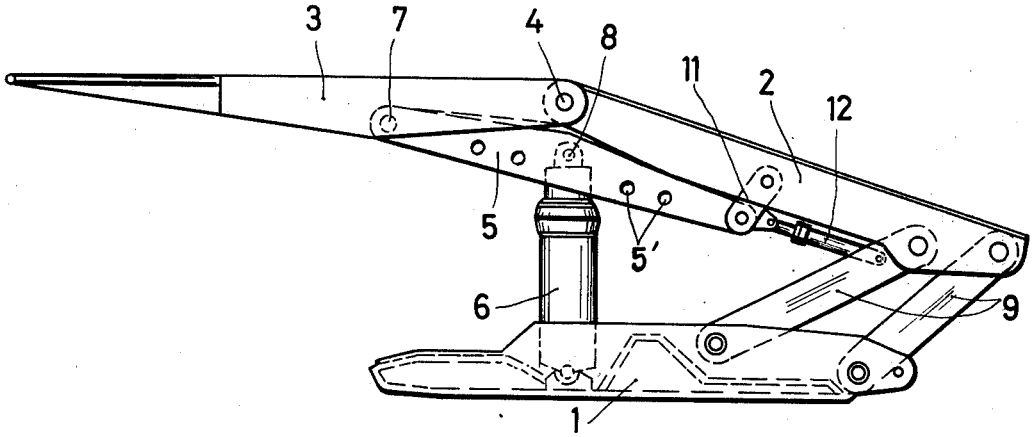
FIG. 2 is a side view of a second embodiment.

In the embodiment shown in FIG. 2, a short link 11 is pivotally connected at one eny to the right end, as viewed in FIG. 2, of the rocker arm 5 and at the other end to the rear shield 2 intermediate the ends of the latter. The cylinder and piston means 12, in the embodiment shown in FIG. 5, are connected at opposite ends thereof to the link 11 and the front arm 9 of the two arms which connect the rear shield 2 with the sole plate 1.

Figure 3:
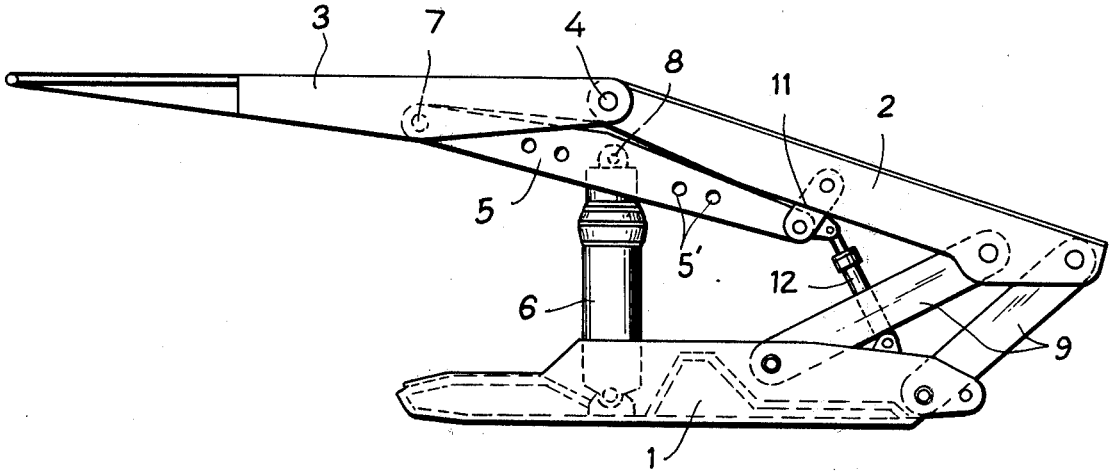
FIG. 3 is a side view of a third embodiment.

In the embodiment shown in FIG. 3, the floating connection between the right end of the rocker arm 5, as viewed in FIG. 3 and the rear shield 2 is likewise provided, in the same manner as in the embodiment shown in FIG. 2, by a short link 11, whereas the cylinder-and-piston means 12 are pivotally connected at opposite ends to the link 11 and the sole plate 1, respectively.

It will be understood that each of the elements described above, or two or more together, may also find a useful application in other types of mine roof support for an underground mine gallery differing from the types described above.

While the invention has been illustrated and described as embodied in a mine roof support in which a rocker arm is pivotally connected at opposite ends to the front shield and the rear shield of the mine roof support, it is not intended to be limited to the details shown, since various modifications and structural changes may be made without departing in any way from the spirit of the present invention.

Without further analysis, the foregoing will so fully reveal the gist of the present invention that others can by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A mine roof support for an underground mine gallery comprising a sole plate adapted to rest on the floor of the mine gallery; a front shield adapted to engage the roof of the mine gallery and having a front end directed toward the mine face; a rear shield having a front end pivotally connected to the other end of said front shield and projecting rearwardly from the latter; a rocker arm connected at opposite ends respectively to said front and said rear shield intermediate the ends of said shields; expandable and contractable prop means supporting said rocker arm on said sole plate; and arm means pivotally connected to the other end of said rear shield and said sole plate.

2. A mine roof support as defined in claim 1, wherein said rocker arm is pivotally connected at one end to one of said shields and including means for floatingly connecting the other end of said rocker arm to the other of said shields.

3. A mine roof support as defined in claim 1, wherein said rocker arm is pivotally connected at one end to said front shield and floatingly connected to said rear shield.

4. A mine roof support as defined in claim 1, wherein said prop means has an upper end and means for selectively connecting said upper end to one of a plurality of points of said rocker arm which are arranged spaced from each other in the longitudinal direction of the latter.

5. A mine roof support as defined in claim 4, wherein said selective connecting means comprise a plurality of bores through said rocker arm spaced from each other in said direction and a pin extending through a bore in said upper end of said prop means and a selected bore of said plurality of bores.

6. A mine roof support as defined in claim 1, wherein said arm means comprises two arms, each pivotally connected at opposite ends thereof to the region of said other end of said rear shield and said sole plate, respectively.

7. A mine roof support as defined in claim 2, wherein said means for floatingly connecting said other end of said rocker arm to the other of said shields comprises a sliding bar connected at one end to said other end of said rocker arm and fluid operated cylinder-and-piston means connecting the other end of said sliding bar to said rear shield.

8. A mine roof support as defined in claim 2, wherein said means for floatingly connecting said other end of said rocker arm to the other of said shields comprises a link pivotally connected at opposite ends to said other end of said rocker arm and to said rear shield, respectively, and fluid operated cylinder-and-piston means connected at one end to said link and at the other end to said arm means.

9. A mine roof support as defined in claim 2, wherein said means for floatingly connecting said other end of said rocker arm to said other of said shields comprise a link pivotally connected at opposite ends to said other end of said rocker arm and to said rear shield, respectively, and fluid-operated cylinder-and-piston means connected at one end to said link and at the other end to said sole plate.

10. A mine roof support as defined in claim 1, wherein said prop means is pivotally connected at its upper end to said rocker arm.

* * * * *